United States Patent [19]

Travis et al.

[11] 3,972,653

[45] Aug. 3, 1976

[54] IN-LINE PUMP DEVICE

[76] Inventors: Larry G. Travis, 2106 Rimrock, Kemah, Tex. 77565; Paul J. Taylor, 9935 Sagerock Drive, Houston, Tex. 77034

[22] Filed: Feb. 10, 1975

[21] Appl. No.: 548,289

[52] U.S. Cl. ..... 417/356; 415/72

[51] Int. Cl.[2] ..... F04B 17/04

[58] Field of Search ..... 417/356, 355; 415/71, 415/72

[56] References Cited

UNITED STATES PATENTS

| | | | |
|---|---|---|---|
| 1,534,451 | 4/1925 | Kauter | 417/356 |
| 2,293,508 | 8/1942 | Killam | 417/356 X |
| 2,500,400 | 3/1950 | Cogswell | 417/356 X |
| 3,164,096 | 1/1965 | Hallerback | 417/356 |
| 3,273,506 | 9/1966 | Jamieson | 417/356 |
| 3,479,960 | 11/1969 | Cardoso | 417/356 |

FOREIGN PATENTS OR APPLICATIONS

| | | | |
|---|---|---|---|
| 1,134,967 | 4/1957 | France | 417/356 |

*Primary Examiner*—C. J. Husar
*Assistant Examiner*—Leonard Smith
*Attorney, Agent, or Firm*—Pravel & Wilson

[57] ABSTRACT

An in-line pump device having a hollow, power shaft formed with an internal rotary chamber having an impeller vane assembly mounted therein to pump a fluid therethrough, the power being supplied by a motor positioned substantially about the power shaft.

6 Claims, 2 Drawing Figures

IN-LINE PUMP DEVICE

BACKGROUND OF THE INVENTION

The field of this invention is pumping apparatus.

One common type of pump includes a pump housing which includes a stationary chamber portion for receiving fluid from a suction port and discharging fluid through a discharge port, the suction and discharge ports being connected to a fluid flowline network such as a pipeline. An external power source is provided by an electric motor or other power device mounted onto the outside of the housing. The external power source is attached to a drive shaft which extends through the pump housing to a position within the housing chamber. An impeller is mounted on the drive shaft for rotation with the drive shaft in response to activation of the external power source. Rotation of the impeller by the external motor and shaft combination causes the impeller to apply radial and/or axial fluid forces to a fluid passing through the housing chamber from suction to discharge.

Another type of pump features an "in-line" design wherein the impeller is connected directly to the rotor of an electric motor and the rotor is mounted for rotation about a stationary hollow shaft. The stator windings of the motor are mounted in a sealed housing that surrounds the rotor. Fluid enters at the suction, flows straight through the hollow shaft, to the impeller and through the entire rotor cavity to the discharge. A non-magnetic stator lining hermetically isolates the fluid from the motor windings, but allows their rotating magnetic field to turn the rotor and impeller. The fluid circulates through the entire rotor cavity to lubricate the bearings and cool the motor. A pump of this type is manufactured by the Crane Co., Chempump Division, Warrington, Pennsylvania.

SUMMARY OF THE INVENTION

This invention relates to a new and improved pumping apparatus for applying mechanical energy in the form of centrifugal and/or axial flow forces to a fluid flowing through a flowline. The new and improved pumping assembly includes a housing adapted for mounting in such a flowline and impeller means mounted substantially within the housing for rotation with respect to the housing. The impeller means includes means for applying mechanical energy to a fluid flowing through the flowline. Motive power means are mounted with the housing substantially about the impeller means for rotating the impeller means to cause said impeller means to apply mechanical energy to the flowline fluid. The impeller means includes a rotary chamber mounted in the housing and rotation mounting means mounting the rotary chamber for rotation with respect to the housing. The rotary chamber is substantially aligned with the fluid flowline and rotary seal means provide a rotary seal to substantially prevent the passage of flowline fluid into the housing so that the rotary chamber receives and applies mechanical energy to substantially all of the fluid flowing through the flowline.

The impeller means includes a power shaft positioned within the housing and shaft mount means mounting the power shaft for rotation therein. The power shaft has an impeller chamber formed therein for receiving the flowline fluid, the impeller chamber having mounted therein an impeller vane assembly rotatable with the power shaft.

In the preferred embodiment of this invention, the motive power means is mounted with the housing and the power shaft substantially about the impeller chamber for rotating the power shaft thereby rotating the impeller vane assembly mounted in the impeller chamber.

DESCRIPTION OF THE PREFERRED EMBODIMENT

Figure 1:
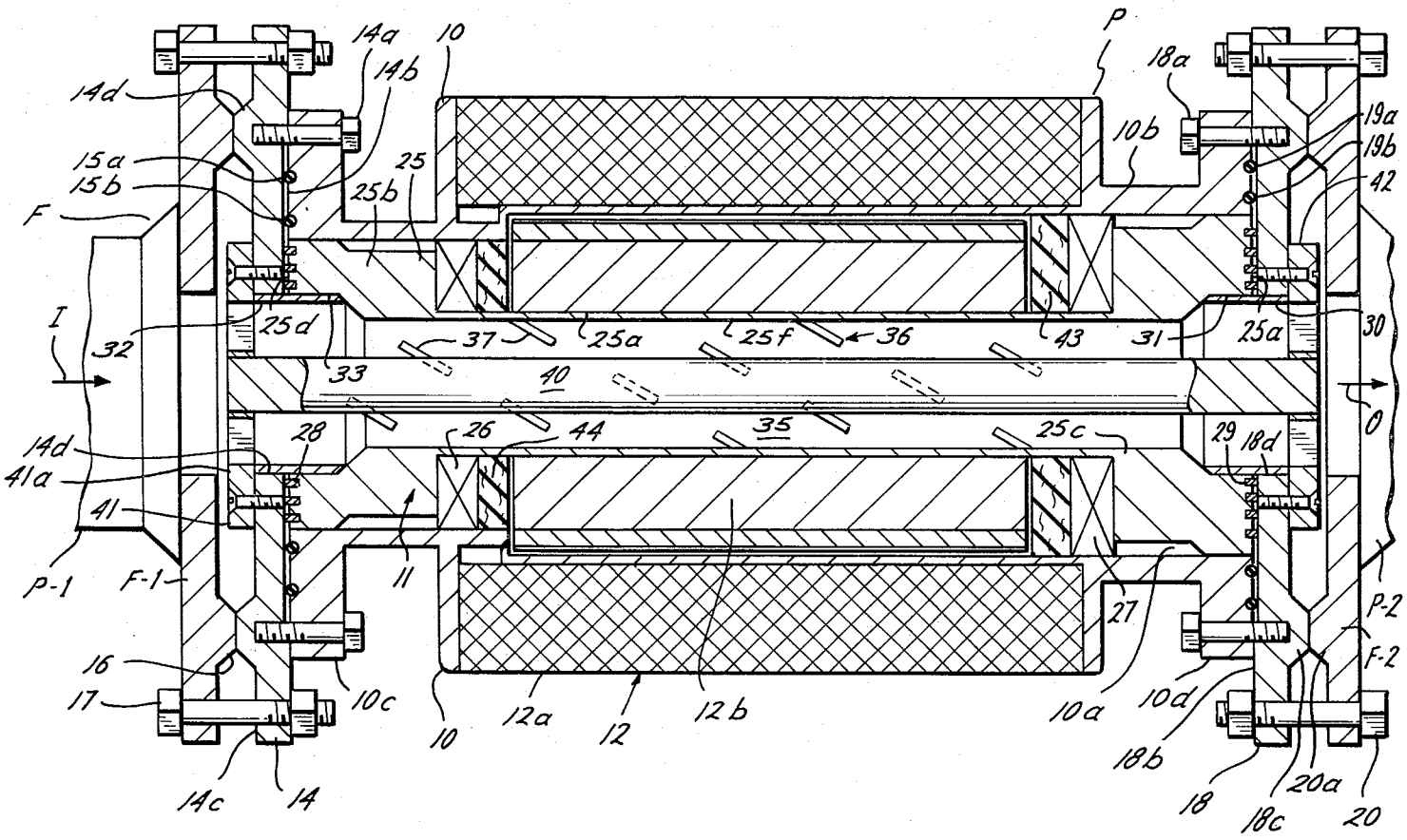
FIG. 1 is a sectional view of the in-line pump device of the preferred embodiment of the invention illustrated in position in a flowline.
Figure 2:
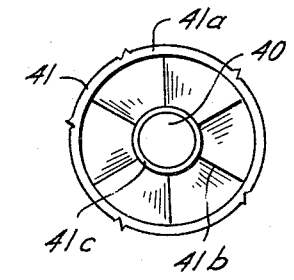
FIG. 2 is an end view of an alternate or optional improvement of this invention illustrating the mounting of a central stabilizing rod in the rotary chamber of the in-line pump device.

Referring to the drawings, the letter P generally designates the in-line pumping device of the preferred embodiment of this invention for mounting in a flowline F for applying radial and/or axial flow forces to a fluid flowing through the flowline. The flowline F illustrated in the drawings includes a first flowline flange F-1 which is attached in a known manner such as welding to a pipeline portion P-1. A second flowline flange F-2 attached to a pipeline portion P-2 is positioned sufficient distance away from the flowline flange F-1 to receive the pump P. It should be understood that it is within the scope of this invention to utilize the pump P in any type of flowline system; therefore, the pipeline portions P-1 and P-2 are merely representative of any type of pipeline, vessel, tank, column or other flow network. The pump P of the preferred embodiment of this invention is adapted to be mounted within any such flowline network such as the flowline F for the purpose of applying mechanical energy (pumping) to fluid received at the inlet or suction I and discharged at the outlet or discharge O.

In the preferred embodiment of this invention, the in-line pump P includes a housing 10 which is adapted for mounting between the flowline flanges F-1 and F-2. An impeller means generally designated as 11 is mounted substantially within the housing 10 for rotational movement with respect thereto. Motive power means generally designated as 12 are mounted with the housing 10 and the impeller means 11 for providing rotative motion to the impeller means 11 whereby the impeller means 11 imparts mechanical energy to the fluid flowing through the pump P.

The housing 10 is generally cylindrical in cross section and includes a hollow, cylindrical opening **10*a*. The housing 10 further includes a main, annular body portion 10*b* which terminates in annular end portions 10*c* and 10*d*. The annular end portions 10*c* and 10*d* are integrally formed with the main body portion 10*b* in the embodiment of the invention described herein. The annular end portion 10*c* is attached to a flange-type connector 14 by means of bolts 14*a*. One face 14*b* of the flange-type connector 14 is suitably machined to provide a sealing surface. Annular seal rings 15*a* and 15*b* are mounted in the annular end housing portion 10*c* and sealably engage the flange-type connector face 14*b* in order to prevent the passage of fluid therebetween. The other flange-type connector face 14*c* includes an annular raised surface portion 14*d* which is adapted to engage a corresponding raised surface portion 16 on the flange F-1 to provide a typical metal-to-metal flange seal. The actual connection between the flange F-1 and the flange-type connector 14 of the housing 10 is accomplished by a series of circumferentially spaced bolts 17. Such a flange connection between the flowline flange F-1 and the flange-type housing connector 14** is well known in the art.

In a similar manner, the annular housing end portion 10*d* is connected by bolts 18*a* to a flange-type connector 18. The flange-type connector 18 includes a smooth, internal face 18*b* which receives annular seal rings 19*a* and 19*b* mounted in the annular housing end portion 10*d*. The flange-type housing connector 18 is attached to the flowline flange F-2 by a series of bolts 20. An external, annular raised surface 18*c* sealably engages in metal-to-metal contact a corresponding raised surface 20*a* of the flowline flange F-2. In this manner, the pump housing 10 is sealably mounted in the flowline F in attachment to the flowline flanges F-1 and F-2.

The impeller means 11 includes a hollow, rotary, power shaft 25 mounted in the pump housing opening 10*a* for rotation with respect thereto. The hollow, power shaft 25 includes a central, cylindrical portion 25*a* which terminates in enlarged annular end portions 25*b* and 25*c*. The shaft 25 is mounted for rotation within the housing opening 10*a* by means of thrust bearings 26 and 27. The thrust bearings 26 and 27 may be of any suitable type and are mounted in a well-known manner between the inside, cylindrical housing wall 10*a* and the shaft 25. Shaft end portion 25*b* includes a machined end surface 25*d* which is opposite to the flange-type connector face 14*b*. A series of annular carbon rings 28 are mounted in the shaft end portion face 25*d* and sealably engage the suitably machined flange connector surface 14*b* in order to provide a rotating, mechanical seal between the shaft end the flange-type connector face 14*b*. It should be understood that any other type of suitable mechanical, rotating seal may be provided in order to seal against the passage of fluid between the shaft end portion 25*b* and the flange-type connector face 14*b*. A series of annular carbon rings 29 are also mounted in shaft end portion face 25*e* for rotatably, sealingly engaging the suitable machined flange-type connector surface 18*b*.

A sleeve insert 30 is mounted in shaft end portion opening 31 and extends outwardly into flange connector circular opening 18*d*. The sleeve insert 30 is affixed for rotation with the shaft 25 in the shaft end portion opening 31 by any suitable means such as a friction fit. The purpose of the sleeve insert 30 is to help prevent the passage of fluid into the space between the shaft end portion face 25*e* and the adjacent flange-type connector face 18*b*. A similar sleeve insert 32 is mounted in shaft end portion opening 33 and extends into flange-type connector opening 14*d* in order to help prevent the passage of fluid between shaft end portion face 25*d* and the flange-type connector face 14*b*.

The central shaft portion 25*a* is integrally formed with the shaft end portions 25*b* and 25*c*. The central shaft portion 25*a* is hollow and forms a rotating impeller chamber 35 having cylindrical inside wall 25*f*.

An impeller vane assembly generally designated by the number 36 is mounted in the impeller chamber 35 for rotating with the shaft 25 for pumping fluid from the inlet I to the outlet O. In the embodiment of this invention illustrated in FIG. 1, the impeller vane assembly 36 includes a plurality of axial flow vane impellers 37 which are attached by welding or otherwise to the inside shaft wall 25*f* and extend radially inwardly toward the central axis (not shown) of the shaft 25. The axial flow vane impellers 37 serve to engage and apply axial flow forces to the fluid flowing through the rotating chamber 35. As is well known in the art, such axial flow vane impellers generally are utilized to pump large flow capacities of fluid with some increase in head pressure. See Centrifugal and Axial Flow Pumps, Theory, Design and Application, A. J. Stepanoff, pages 22, 63, 66 and 91.

The use of axial flow vane impellers 37 is by way of example only. For instance, it is within the scope of this invention to provide the impeller vane assembly 36 with a plurality of radial flow vane impellers mounted onto the inside shaft wall 25*f* and extending inwardly therefrom. The utilization of radial flow vane impellers will impart radial flow forces to the fluid flowing through the rotating chamber 35 thereby imparting to the liquid only substantially centrifugal force. As is known in the art, the radial flow vane impellers tend to provide high pressure head increases but are capable of pumping smaller flow capacities as compared with axial flow vane impellers. See Stepanoff, pages 22, 58 and 89.

The impeller vane assembly 36 may be formed by a plurality of mixed flow vane impellers mounted onto the inside shaft wall 25*f* and extending inwardly therefrom in order to impart to the fluid flowing through the rotating chamber a combination of radial and axial flow forces. As is known in the art, the advantage of utilizing mixed flow vane impellers lies in the ability of such impellers to provide at least a part of the head pressure increase normally attained with radial flow vane impellers and at least part of the flow capacity attained with axial flow vane impellers. See Stepanoff, pages 23, 69, 92 and 106.

It is within the scope of this invention to utilize axial flow vane impellers 37, or radial flow vane impellers or mixed flow vane impellers or any other impeller design which can be mounted within the rotating chamber 35 for the purpose of transmitting flowline fluid through the flowline F. See Hydraulic Inst. Standards for Centrifugal, Rotary and Reciprocating Pumps, 12th Ed., 1969, pages 10–11 and 15.

As an alternate feature, a central stabilizing rod 40 may be mounted in the center of the rotating chamber 35 for stabilizing the travel of the fluid through the rotating axial vane impellers 37. The central stabilizing rod 40 extends through the entire shaft 25 and is mounted onto the flange-type connectors 14 and 18 by supports 41 and 42. The supports 41 and 42 are identical except for location. Each includes a mounting ring such as 41*a* which is attached to the flange-type connectors 14 and 18 by suitable screws. A series of radially directed spokes 41*b* extend from the mounting ring 41*a* radially inwardly to a mounting hub 41*c*, which mounting hub receives and supports the stabilizing rod 40. Further, it should be understood that any other type of suitable mounting may be utilized to mount the central stabilizing rod 40 at substantially the rotation center of the rotating chamber 35. It is also within the scope of this invention to utilize the central stabilizing rod 40 with other vane configurations. For example, the central stabilizing rod 40 may also be used with mixed flow vane impellers which have been previously described but are not particularly shown in the drawings since such impellers are well known in the art.

The motive power means 12 is an ac induction motor in the embodiment of the invention illustrated herein. The stator 12*a* for the ac motor is mounted onto the housing 10 by suitable means. And, the rotor 12*b* for the ac induction motor is mounted onto the shaft 25. Annular packing rings 43 and 44 may be positioned between the thrust bearings 26 and 27 and the rotor 12*b*. The application of ac electrical current to the stator 12*a* for the ac induction motor in a well-known manner will induce rotation of the rotor 12*b* and thus of the shaft 25.

It should be understood that it is within the scope of this invention to utilize other types of electrical motors, whether ac or dc, if necessary for a particular application of the pump P. In addition, other forms of motive force may be utilized. For example, it is within the scope of this invention to utilize steam driven motors or turbines mounted with the housing 10 and the shaft 25 in order to impart rotating motion to the chamber 35 and the impeller vane assembly 36 mounted therein. It is further within the scope of this invention to use other types of fluid driven motors than steam driven motors. In general, it is within the scope of this invention to utilize any kind of motor force which is capable of being mounted about the hollow shaft 25 for the purpose of imparting rotation thereto.

As a further feature of this invention, the annular carbon rings such as 28 may be supplanted by a throttle bushing, which is known in the art and is available from Dura Metallic Corporation, see Dura Seal Manual, 5th Ed., page 59, for the purpose of allowing slight flow in the passageway between the shaft end faces 25*d* and 25*e* and the adjacent flange-type connectors 14 and 18, respectively. This small amount of flow would then pass in the annular space between the rotating shaft 25 and the inside wall of the housing opening 10*a* in order to provide cooling to the induction motor. The circulation between the rotating shaft 25 and the housing 10 would flow from the high pressure outlet side O toward the lower pressure inlet side I.

The foregoing disclosure and description of the invention are illustrative and explanatory thereof, and various changes in the size, shape, and materials as well as in the details of the illustrated construction may be made without departing from the spirit of the invention.

For example, the pump P has been disclosed as a device for imparting energy to a fluid flowing through the flowline F. However, it should be understood, that it is within the scope of this invention, and all claims drawn herein are equivalent to, an energy generating device which utilizes the fluid flowing through the flowline F as a driving force for driving and rotating the shaft 25 for the purpose of transmitting power outwardly thereof. For example, it is within the scope of this invention to replace the motive force 12 with a generator such that rotation of the rotor 12*b* will cause a generation of electricity with the fluid flowing through the flowline F providing the generating force.

We claim:

1. A new and improved pump device for applying mechanical energy to a fluid flowing through said device, comprising:

a housing adapted for mounted in a flowline having a fluid flowing therethrough;

a power shaft positioned in said housing and shaft mount means mounting said power shaft for rotation therein;

said power shaft having a chamber for receiving such flowline fluid and including impeller means for applying mechanical energy to such flowline fluid;

motive power means mounted with said housing substantially about said power shaft for rotating said power shaft in order to apply mechanical energy to such flowline fluid;

said power shaft chamber having mounted therein an impeller means rotatable with said power shaft;

said motive power means being mounted with said housing and with said power shaft for rotating said power shaft thereby rotating said impeller means in order to apply mechanical energy to such fluid flowing through such flowline; and a central stabilizing rod mounted with said housing and extending through said power shaft chamber for cooperating with said impeller vane assembly for applying mechanical energy to such fluid flowing through such flowline.

2. The structure set forth in claim 1, wherein said rotary power shaft includes:

a rotary chamber aligned with said flowline; and, rotary seal means for substantially preventing the passage of flowline fluid from said flowline into said housing such that said rotary chamber receives and applies mechanical energy to substantially all of said fluid flowing through said flowline.

3. The structure set forth in claim 1, wherein:

said power shaft is an elongated cylindrical member; and said power shaft having a cylindrical inside wall which forms said impeller chamber in an elongated cylindrical configuration.

4. The structure set forth in claim 1, wherein:

said impeller means is an axial flow impeller assembly including a plurality of axial flow vanes mounted on the wall forming said power shaft chamber and extending inwardly toward said central stabilizing rod.

5. The structure set forth in claim 1, wherein said motive power means includes:

an electric power means mounted with said housing and said power shaft for rotating said power shaft.

6. The structure set forth in claim 5, wherein said electric power means includes:

an electric motor rotor mounted with said power shaft; and an electric motor stator mounted with said housing.

* * * * *